US007065997B2

(12) United States Patent
Mologni

(10) Patent No.: US 7,065,997 B2
(45) Date of Patent: Jun. 27, 2006

(54) APPARATUS FOR CUTTING AND NIBBLING A SHEET METAL IN COIL FORM

(76) Inventor: Fabrizio Mologni, Via Cavour, 31, I-24061 Albano S. Alessandro, Bergamo (IT)

( * ) Notice: Subject to any disclaimer, the term of this patent is extended or adjusted under 35 U.S.C. 154(b) by 28 days.

(21) Appl. No.: 10/500,743

(22) PCT Filed: Apr. 15, 2003

(86) PCT No.: PCT/IT03/00236

§ 371 (c)(1),
(2), (4) Date: Jul. 6, 2004

(87) PCT Pub. No.: WO03/097271

PCT Pub. Date: Nov. 27, 2003

(65) Prior Publication Data

US 2005/0028573 A1 Feb. 10, 2005

(30) Foreign Application Priority Data

May 21, 2002 (IT) ..... MI2002A1096

(51) Int. Cl.
*B21D 3/05* (2006.01)
*B21D 28/00* (2006.01)

(52) U.S. Cl. ..... 72/131; 72/160; 83/49; 83/552; 83/916

(58) Field of Classification Search ..... 72/131, 72/160; 83/916, 552, 56, 41, 49, 213–217
See application file for complete search history.

(56) References Cited

U.S. PATENT DOCUMENTS

| | | | | |
|---|---|---|---|---|
| 3,124,290 | A | 3/1964 | Lloyd | |
| 3,880,020 | A * | 4/1975 | Clem | 76/104.1 |
| 4,138,913 | A * | 2/1979 | Gentile | 83/236 |
| 4,761,980 | A | 8/1988 | Kawashima et al. | |
| 4,887,502 | A * | 12/1989 | Voges | 83/479 |
| 5,088,181 | A * | 2/1992 | Jeppsson | 29/563 |
| 6,857,350 | B1 * | 2/2005 | Liefer et al. | 83/872 |

FOREIGN PATENT DOCUMENTS

| | | |
|---|---|---|
| FR | 2 471 231 | 6/1981 |
| JP | 60-141342 | 7/1985 |
| WO | WO 86/01135 | 2/1986 |

* cited by examiner

*Primary Examiner*—Daniel C. Crane
(74) *Attorney, Agent, or Firm*—James V. Costigan; Hedman & Costigan

(57) ABSTRACT

An apparatus for cutting and nibbling a sheet metal (3) in coil form comprises pulling devices for pulling the sheet metal, which is delivered from a delivery bobbin or coil, and are driven by a pair of overlapping rollers (12), the sheet metal being adapted to intermittently advance, stop and move backward, the sheet metal being processed by machining heads (15,16), which are arranged at the top and bottom portions of the sheet metal and are designed for transversely move with respect to the sheet metal feeding direction.

16 Claims, 3 Drawing Sheets

APPARATUS FOR CUTTING AND NIBBLING A SHEET METAL IN COIL FORM

BACKGROUND OF THE INVENTION

The present invention relates to an apparatus which has been specifically designed for cutting geometric patterns and performing drawing and marking operations.

Said marking operation, in particular, allows to mark, by a small incision, bending line trajectories or path arrangement.

The apparatus, moreover, allows to apply branding and code patterns, as well as allows to customize articles of manufactures by applying thereto signs such as logos, with a very high operating speed.

Apparatus for cutting and nibbling sheet metals are already known; however, in this prior apparatus, the sheet metal elements to be processed must be necessarily pre-cut in lengths or plates.

The cut lengths or plates, after the cutting operation, must be supported on processing surfaces, and then clamped by performing manual clamping operation, to allow the sheet metal length to be suitably driven with respect a pair of machining overlapped heads.

The latter, in prior apparatus of the above mentioned type, operate on a vertical fixed axis, thereabout said operating head can turn.

Thus, it should be apparent that the above mentioned machining operations must be necessarily performed with a comparatively small operating speed, since it is necessary to perform preliminarily operations of loading, clamping the sheet metal elements on the processing surface, and then taking and unloading the processed sheet metal elements one at a time.

Moreover, before the above mentioned operations, it is necessary to properly prepare the sheet metal elements, which must be formed from strips or coils by using cutters for performing a plurality of cuts, thereby broad surfaces for accumulating and storing the precut sheet metal elements would be required.

SUMMARY OF THE INVENTION

Accordingly, the aim of the present invention is to provide an apparatus for cutting and nibbling a sheet metal in coil form, which allows to greatly simplify the above mentioned machining operations, while directly using strip like sheet metal elements, as directly delivered from coils, without any need of pre-cutting the sheet metal elements.

Within the scope of the above mentioned aim, a main object of the present invention is to provide such a cutting and nibbling apparatus, which can process sheet metal elements with a very high processing or machining speed, thereby providing a high processing yield.

Another object of the present invention is to provide such a cutting and nibbling apparatus which can process sheet metal elements driven by pairs of overlapped rollers to be directly machined by overlapping operating head, designed for moving along a transversal operating direction.

BRIEF DESCRIPTION OF THE DRAWINGS

The above mentioned, and yet other features, of functional and constructional nature of the apparatus for cutting and nibbling sheet metal elements in coil form will become more apparent hereinafter from the following detailed disclosure of a preferred embodiment thereof, with reference to the figures of the accompanying drawings, where.

DESCRIPTION OF THE PREFERRED EMBODIMENT

Figure 1:
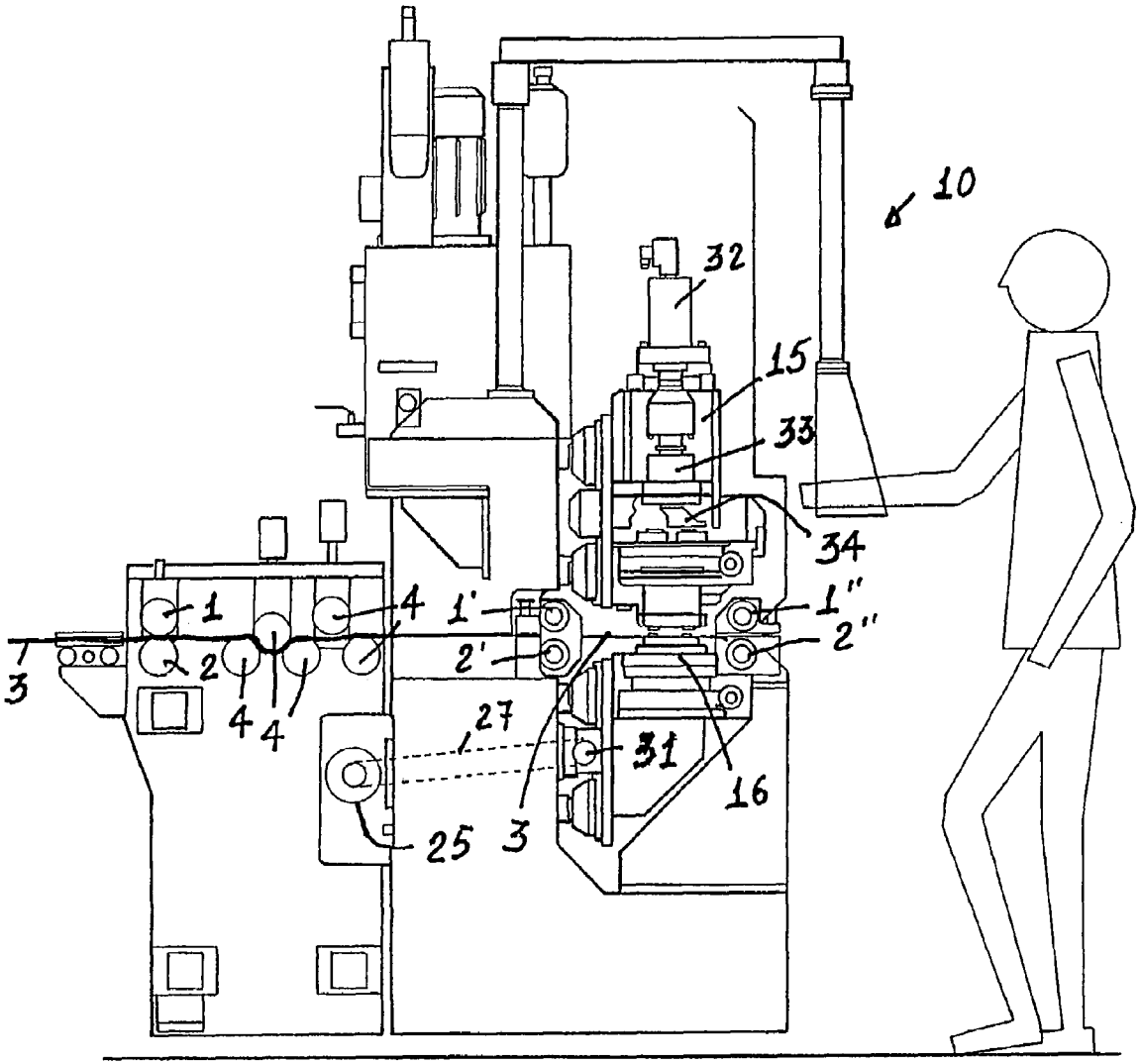
FIG. 1 shows a side elevation view of the cutting and nibbling apparatus according to the invention.
Figure 2:
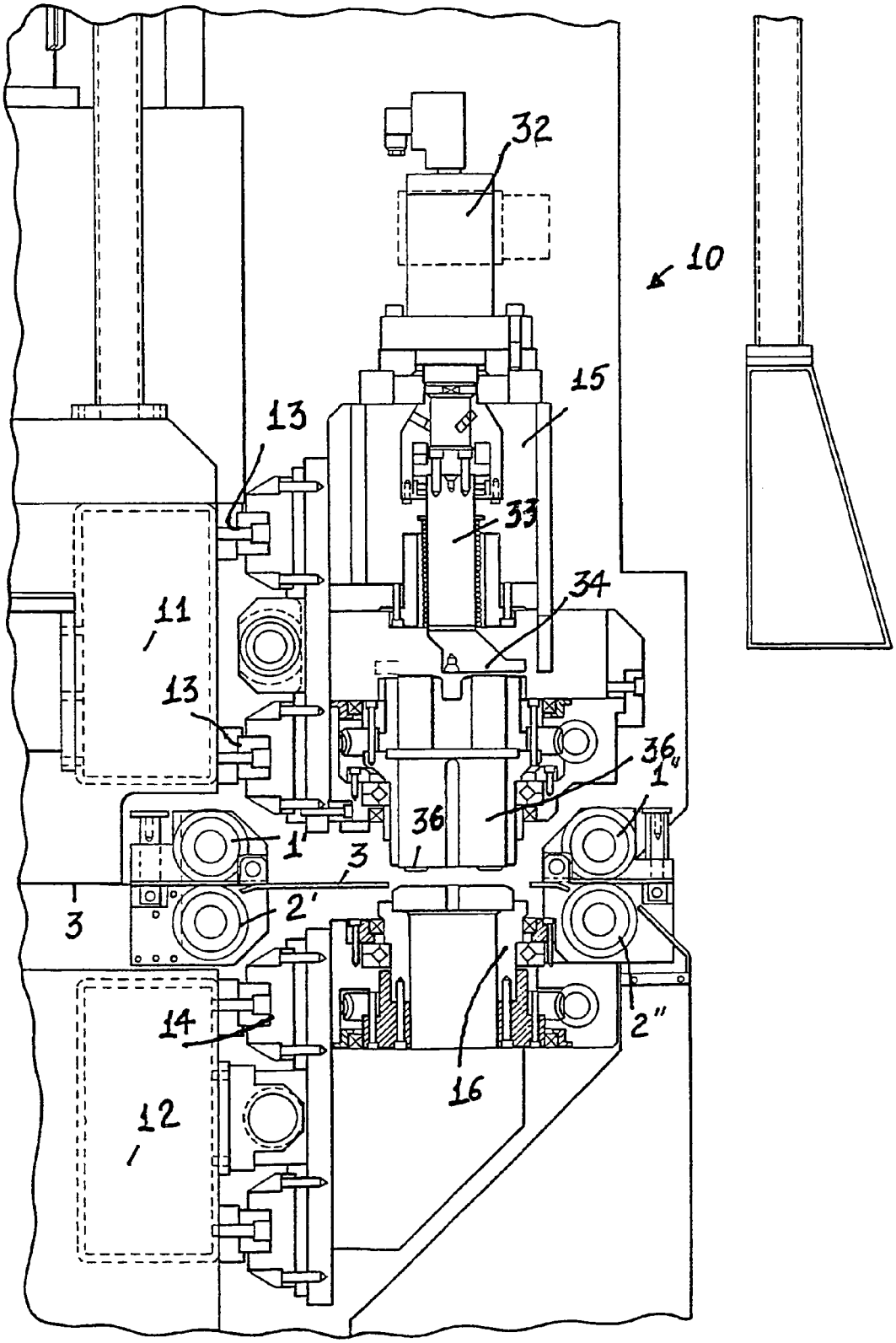
FIG. 2 illustrates a partial detailed view, on an enlarged scale, of the cutting and nibbling apparatus shown in FIG. 1.
Figure 3:
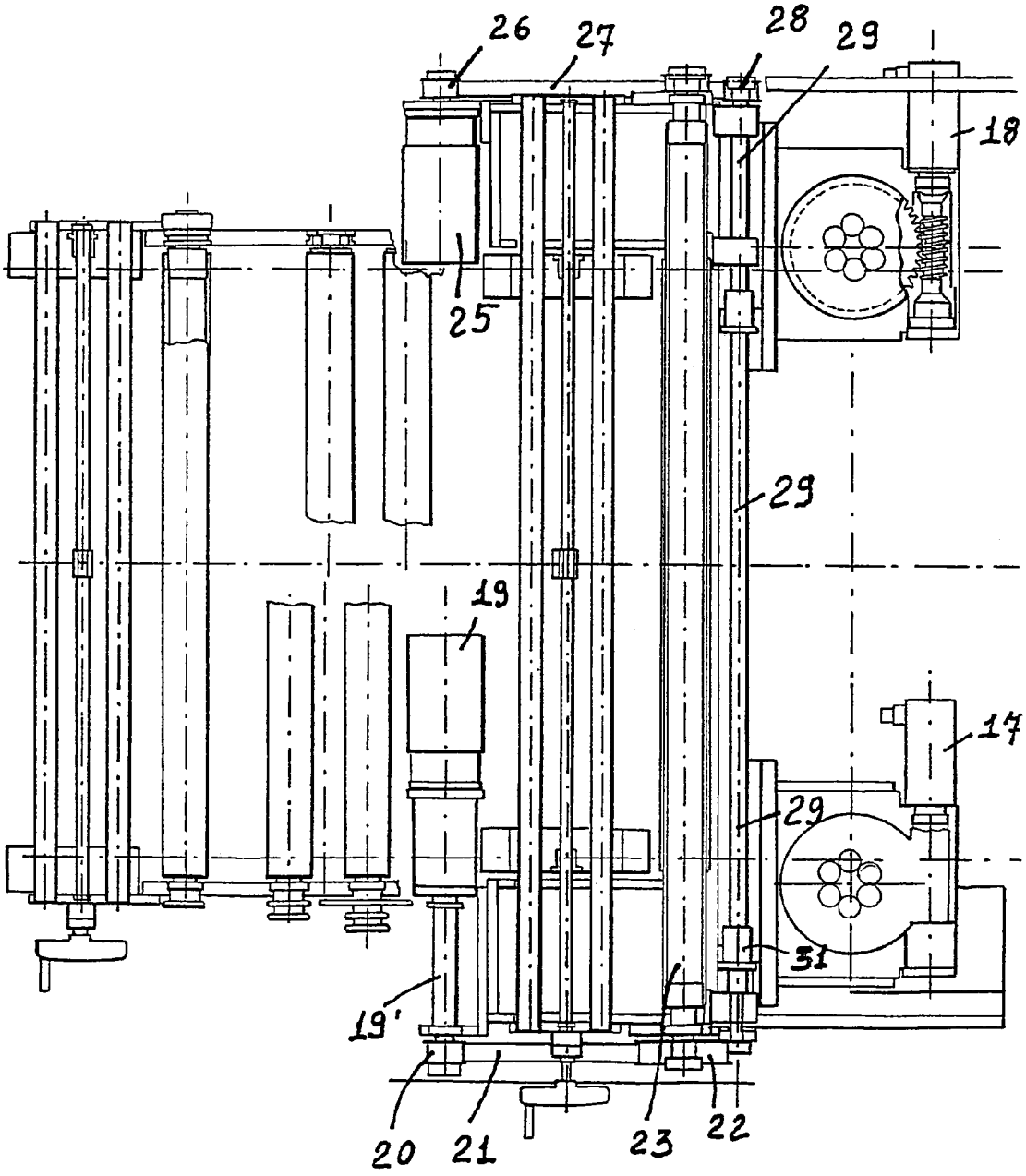
FIG. 3 is a cross-sectioned top plan view illustrating the cutting and nibbling apparatus according to the invention.

With reference to the number references of the above mentioned figures, the cutting and nibbling apparatus according to the invention, which has been generally indicated by the reference number 10, is designed for processing strip sheet metal elements 3, as supplied by coils.

Said sheet metal elements, in particular, which are delivered by a bobbin or coil, are driven by pairs of overlapped rollers 1 and 2, 1' and 2', 1" and 2".

The apparatus 10 comprises moreover a plurality of offset rollers 4 provided for performing a series of folding and counter-folding operations, to provide the sheet metal element 3 in a perfectly flat condition.

The sheet metal element feeding movement is performed in a continuous manner, with intermittent feeding steps, stop steps and also backward movement steps.

The device for unwinding the coil is synchronized with the feed, stop and back movements of the sheet metal element 3.

The apparatus 10 according to the invention comprises furthermore two beams 11 and 12, which are transversely arranged with respect to the sheet metal feeding direction, at the top and bottom respectively of said sheet metal element.

As shown, the beams 11 and 12 support cross guides 13 and 14, parallel to the first, which support the movable operating heads 15 and 16.

Said operating or machining heads, in particular, can be driven parallel to the beams 11 and 12 and in a cross direction with respect to the sheet metal element driving direction.

Said operating or machining heads 15 and 16 can turn about a vertical machining axis, which can be transversely displaced, and being provided with a plurality of punch elements, arranged with a circular arrangement, designed for cooperating with corresponding dies applied to the bottom head 16.

The machining heads 15 and 16 are rotatively driven by brushless motors 17 and 18.

The cutting and nibbling apparatus according to the invention also comprises a geared motor unit 19, the shaft 19' of which supports a toothed pulley 20, entraining a toothed belt 21.

The toothed belt 21, in particular, rotatively drives a second toothed pulley 22, keyed on the shaft 23.

Said shaft 23, in turn, longitudinally drives the sheet metal element 3, by operating a pair of feeding rollers 1, 2, which are connected with other pairs of feeding and pulling rollers 1', 2' and 1", 2".

The brushless motor assembly 25 comprises a further toothed pulley 26, entraining a toothed pulley 27 thereon, said toothed pulley 27 in turn rotatively driving a further pulley 28.

The pulley 28, as shown, is keyed on a screw element 29 engaging with a scroll element 30, which operatively drives a top punch bearing head 15, by causing said head 15 to translate along guide elements 13.

The screw 29 cooperates with a second scroll element 31, which operatively drives the bottom die bearing head 16.

The subject apparatus comprises furthermore a hydraulic cylinder 32, which vertically drives a wing element 33 having, at the bottom thereof, an eccentric lug 34.

Said wing 33 selectively presses a punch element 36, which is radially arranged against the corresponding die therefor.

The wing 33, in particular, is adapted to freely rotate, as entrained by the rotary head 15.

Thus, the wing 33, in its lowering movement, will engage the eccentric lug 34 in a cavity corresponding to the punch element 36 to be driven.

The wing 33 and its eccentric lug 34, engaging with a said punch element 36 are rotatively driven by the rotary movement of the head 15.

The feeding movements of the sheet metal element, as well as the cross translating movements of the heads 15 and 16 and their rotary movements are controlled and timed or synchronized by a digital control central unit.

While the cutting and nibbling apparatus according to the present invention has been hereinabove disclosed by way of a merely exemplary and not limitative example, it should be apparent that it is susceptible to several modifications and variations, all coming within the scope of the invention.

In particular, the apparatus according to the invention has been specifically designed for machining or processing a sheet metal element which is continuously supplied to said apparatus and which is provided in coil form.

In this connection, it should be apparent that the inventive apparatus, in addition to machining sheet metal elements, can also be used for performing a plurality of different mechanical operations on different material coils or sheets, such as wood, plywood and multi-layer wood material, plastics material, aggregated materials or any materials in strip or sheet form.

Thus, it should be apparent that the cutting and nibbling apparatus according to the invention can be further modified and improved, and without departing from the spirit and scope of the invention.

The invention claimed is:

1. An apparatus for cutting and nibbling a sheet metal element in coil form, said apparatus comprising pulling devices for pulling said sheet metal element, which is delivered from a coil or bobbin and is driven by a pair of overlapped rollers, said sheet metal element being adapted to be intermittently moved, stopped and moved backward, said sheet metal element being cut or nibbled by top and bottom movable machining heads which are arranged above and under said sheet metal element and are transversely driven with respect to a feeding direction of said sheet metal element, said apparatus having two beams arranged transversely with respect to said sheet metal element feeding direction, wherein said beams being adapted to support cross guide elements which are arranged parallel to said beams, and said cross guide elements being adapted to support said movable machining heads, and wherein said apparatus further comprises a plurality of offset rollers performing a series of folding and counter-folding operations for providing said sheet metal element in a perfectly flat condition said machining heads being driven parallel to said beams and transversely of the sheet metal element feeding direction.

2. An apparatus, according to claim 1, wherein said sheet metal element is continuously fed, with intermittent feeding steps, stopping steps and backward moving steps.

3. An apparatus, according to claim 1, wherein said machining heads are rotatable about a transversely driven machining axis.

4. An apparatus, according to claim 1, wherein said machining heads comprise a plurality of circularly arranged punch elements cooperating with corresponding die elements applied to said bottom head.

5. An apparatus, according to claim 1, wherein said machining heads are rotatively driven by brushless motors.

6. An apparatus, according to claim 1, wherein said apparatus further comprises a geared motor unit, said geared motor unit having a shaft supporting a toothed pulley entraining a toothed belt.

7. An apparatus, according to claim 6, wherein said toothed belt rotatively drives a second toothed pulley, keyed on a supporting shaft.

8. An apparatus, according to claim 7, wherein said supporting shaft drives a driving roller pair having rollers which are coupled with other pairs of feeding and driving rollers.

9. An apparatus, according to claim 1, wherein said apparatus comprises a brushless motor assembly having a toothed pulley which entrains a toothed belt rotatively driving a toothed pulley (28) keyed on a worm screw.

10. An apparatus, according to claim 9, wherein said worm screw engages with a scroll element which operatively drives a top punch bearing head so as to cause said head to be translated along its guide elements.

11. An apparatus, according to claim 9, wherein said worm screw cooperates with a second scroll element which operatively drives said bottom head.

12. An apparatus, according to claim 1, wherein said apparatus further comprises a hydraulic cylinder which vertically drives a wing having, at a bottom portion thereof, an eccentric lug, and selectively pressing a radially arranged punch against a corresponding die element therefor.

13. An apparatus, according to claim 12, wherein said wing element is rotatively driven by said top head.

14. An apparatus, according to claim 12, wherein said wing element, as it is lowered, causes said eccentric lug to be engaged in a cavity corresponding to a punch element to be operated.

15. An apparatus, according to claim 12, wherein said wing element and the eccentric lug thereof, are rotatively driven by said head.

16. An apparatus, according to claim 1, wherein said metal sheet element and said heads are controlled and timed by a numeric controlling center unit.

* * * * *